US010832608B2

(12) United States Patent
Guo et al.

(10) Patent No.: US 10,832,608 B2
(45) Date of Patent: Nov. 10, 2020

(54) PIXEL CIRCUIT, METHOD FOR DRIVING METHOD, DISPLAY PANEL, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Wang Guo, Beijing (CN); Yu Zhao, Beijing (CN); Hailong Wang, Beijing (CN); Dawei Feng, Beijing (CN); Mingyang Lv, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/386,778

(22) Filed: Apr. 17, 2019

(65) Prior Publication Data

US 2020/0105175 A1 Apr. 2, 2020

(30) Foreign Application Priority Data

Sep. 28, 2018 (CN) ..... 2018 1 1136665

(51) Int. Cl.
*G09G 3/20* (2006.01)

(52) U.S. Cl.
CPC ..... *G09G 3/20* (2013.01); *G09G 2300/0426* (2013.01); *G09G 2300/0439* (2013.01); *G09G 2300/0809* (2013.01)

(58) Field of Classification Search
CPC ..... G09G 3/20; G09G 2300/0426; G09G 2300/0439; G09G 2300/0809;
(Continued)

(56) References Cited

U.S. PATENT DOCUMENTS 10,621,904 B2 * 4/2020 Wang ..... G09G 3/3696
2009/0146991 A1 * 6/2009 Shimodaira ..... G09G 3/344 345/214

(Continued)

FOREIGN PATENT DOCUMENTS

CN 101452673 A 6/2009
CN 101533608 A 9/2009

(Continued)

OTHER PUBLICATIONS

Chinese Office Action dated Nov. 28, 2019 in related Chinese Application No. 201811136665.X.

*Primary Examiner* — Grant Sitta
(74) *Attorney, Agent, or Firm* — Arent Fox LLP; Michael Fainberg

(57) ABSTRACT

The disclosure relates to a pixel circuit, a method for driving method, a display panel, and a display device. The pixel circuit includes: a scan control circuit, a latch circuit, a charging control circuit, and a pixel electrode; the scan control circuit is configured to output a data signal to a first node in response to a gate scan signal; the latch circuit is configured to latch signals of the first node and a second node response to a signal of the first node; and the charging control circuit is configured to output a first display voltage signal to the pixel electrode in response to the signal of the first node and a charging control signal, and to output a second display voltage signal to the pixel electrode in response to the signal of the second node and the charging control signal.

15 Claims, 5 Drawing Sheets

(58) Field of Classification Search
CPC ..... G09G 3/344; G06F 3/015; G06F 3/017; G06F 3/012; G06F 3/0346; G06K 9/00503; G06K 9/00302; G06K 9/6292; G06K 9/00536; G06K 9/00523; G06K 9/6278; G06K 9/6256; G06K 9/6215; G06K 9/00315; G06K 9/00885; G06K 9/0051; G06K 9/6287; G06K 2009/00939; G06K 2009/6237
See application file for complete search history.

(56) References Cited

U.S. PATENT DOCUMENTS

| | | | | |
|---|---|---|---|---|
| 2013/0063499 | A1* | 3/2013 | Tanaka | G09G 3/3648 345/690 |
| 2015/0097792 | A1* | 4/2015 | Yoshida | G06F 3/04883 345/173 |
| 2016/0203767 | A1* | 7/2016 | Yamazaki | G09G 3/344 345/211 |
| 2017/0148392 | A1* | 5/2017 | Kim | G11C 19/287 |
| 2017/0163146 | A1* | 6/2017 | Suzuki | G11C 16/30 |
| 2018/0047360 | A1* | 2/2018 | Cai | G09G 3/3677 |
| 2019/0096354 | A1* | 3/2019 | Chen | G02F 1/13306 |
| 2019/0206301 | A1* | 7/2019 | Wang | G09G 3/3696 |
| 2020/0004070 | A1* | 1/2020 | Gu | G09G 3/3659 |

FOREIGN PATENT DOCUMENTS

| | | | |
|---|---|---|---|
| CN | 101771402 | A | 7/2010 |
| CN | 107393488 | A | 11/2017 |
| CN | 107945763 | A | 4/2018 |

* cited by examiner

PIXEL CIRCUIT, METHOD FOR DRIVING METHOD, DISPLAY PANEL, AND DISPLAY DEVICE

CROSS-REFERENCE TO RELATED APPLICATION

This application claims priority of Chinese Patent Application No. 201811136665.X, filed on Sep. 28, 2018, which is hereby incorporated by reference in its entirety.

FIELD

The present disclosure relates to the field of display technologies, and particularly to a pixel circuit, a method for driving method, a display panel, and a display device.

BACKGROUND

An electronic-paper display is a new display device with both the advantages of a display, and the advantages of paper, and has the advantages of a flexible display, portability, erasability and writability, low power consumption. At present, the electronic-paper display generally includes an array substrate and an opposite substrate, both of which are arranged opposite to each other, and an electronic ink layer encapsulated between the array substrate and the opposite substrate. The array substrate can generally include: an underlying substrate, gate lines and data lines located on the underlying substrate, and pixel elements surrounded by the data lines and the gate lines. Each pixel element includes a Thin Film Transistor (TFT) and a pixel electrode, where the TFT has a gate connected with a gate line, a source connected with a data line, and a drain connected with a pixel electrode. In order to display an image on the electronic-paper display, the TFT is controlled using a gate scan signal transmitted on the gate line to be switched on to thereby provide a data signal transmitted on the data line to the pixel electrode so as to charge the pixel electrode, thus driving the electronic ink to perform a display function.

SUMMARY

Some embodiments of the disclosure provide a pixel circuit including: a scan control circuit, a latch circuit, a charging control circuit, and a pixel electrode, wherein:

the scan control circuit is configured to output a data signal to a first node in response to a gate scan signal;

the latch circuit is configured to latch the signals of the first node and a second node response to the signal of the first node; and the charging control circuit is configured to output a first display voltage signal to the pixel electrode in response to the signal of the first node, and a charging control signal, and to output a second display voltage signal to the pixel electrode in response to the signal of the second node, and the charging control signal.

Optionally, in some embodiments of the disclosure, the latch circuit includes: a first sub-latch circuit and a second sub-latch circuit, wherein:

the first sub-latch circuit is configured to latch the signal of the second signal as a second reference voltage signal or a first reference voltage signal in response to the signal of the first node; and the second sub-latch circuit is configured to latch the signal of the first node as the first reference voltage signal or the second reference voltage signal in response to the signal of the second node.

Optionally, in some embodiment of the disclosure, the first sub-latch circuit includes: a first switch transistor, a second switch transistor, a third switch transistor, and a fourth switch transistor, wherein:

the first switch transistor has a gate coupled with the first node, a first electrode configured to receive the second reference voltage signal, and a second electrode coupled respectively with a second electrode of the second switch transistor, and a gate of the third switch transistor;

the second switch transistor has a gate and a first electrode, both of which are configured to receive the first reference voltage signal;

the third switch transistor has a first electrode configured to receive the first reference voltage signal, and a second electrode coupled with the second node; and the fourth switch transistor has a gate coupled with the first node, a first electrode configured to receive the second reference voltage signal, and a second electrode connected with the second node.

Optionally, in some embodiments of the disclosure, the first sub-latch circuit further includes a fifth switch transistor, wherein:

the fifth switch transistor has a gate coupled with the first node, a first electrode coupled with the second node, and a second electrode configured to receive the second reference voltage signal.

Optionally, in some embodiments of the disclosure, the second sub-latch circuit includes: a sixth switch transistor, a seventh switch transistor, an eighth switch transistor, and a ninth switch transistor, wherein:

the sixth switch transistor has a gate coupled with the second node, a first electrode configured to receive the second reference voltage signal, and a second electrode coupled respectively with a second electrode of the seventh switch transistor, and a gate of the eighth switch transistor;

the seventh switch transistor has a gate and a first electrode, both of which are configured to receive the first reference voltage signal;

the eighth switch transistor has a first electrode configured to receive the first reference voltage signal, and a second electrode coupled with the first node; and the ninth switch transistor has a gate coupled with the second node, a first electrode configured to receive the second reference voltage signal, and a second electrode coupled with the first node.

Optionally, in some embodiments of the disclosure, the second sub-latch circuit further includes a tenth switch transistor, wherein:

the tenth switch transistor has a gate coupled with the second node, a first electrode coupled with the first node, and a second electrode configured to receive the second reference voltage signal.

Optionally, in some embodiments of the disclosure, the charging control circuit includes: an eleventh switch transistor, a twelfth switch transistor, and a thirteenth switch transistor, wherein:

the eleventh switch transistor has a gate coupled with the first node, a first electrode configured to receive the first display voltage signal, and a second electrode coupled with the first electrode of the thirteenth switch transistor;

the twelfth switch transistor has a gate coupled with the second node, a first electrode configured to receive the second display voltage signal, and a second electrode coupled with the first electrode of the thirteenth switch transistor; and the thirteenth switch transistor has a gate configured to receive the charging control signal, and a second electrode coupled with the pixel electrode.

Optionally, in some embodiments of the disclosure, the scan control circuit includes a fourteenth switch transistor, wherein:

the fourteenth switch transistor has a gate configured to receive the gate scan signal, a first electrode configured to receive the data signal, and the second electrode coupled with the first node.

Correspondingly, some embodiments of the disclosure further provide an array substrate including: a plurality of pixel elements, a plurality of gate lines, a plurality of charging control signal lines, and a plurality of data lines, wherein each row of pixel elements corresponds to one of the gate lines and one of the charging control signal lines, and a column of pixel elements corresponds to one of the data lines; and respective pixel elements include the pixel circuit according to embodiments of the disclosure, wherein respective gate lines are coupled with their corresponding pixel circuits, and configured to transmit the gate scan signal, respective charging control signal lines are coupled with their corresponding pixel circuits, and configured to transmit the charging control signal, and respective data lines are coupled with their corresponding pixel circuits, and configured to transmit the data signal.

Correspondingly, some embodiments of the disclosure further provide a display device including the array substrate according to embodiments of the disclosure.

Optionally, in some embodiments of the disclosure, the display device includes electronic paper.

Correspondingly, some embodiments of the disclosure further provide a method for driving the pixel circuit according to embodiments of the disclosure, the method including:

in the data writing stage, outputting, by the scan control circuit, the data signal to the first node in response to the gate scan signal, and latching, by the latch circuit, the signals of the first node and the second node in response to the signal of the first node;

in the charging stage, latching, by the latch circuit, the signals of the first node and the second node in response to the signal of the first node, and outputting, by the charging control circuit the first display voltage signal to the pixel electrode in response to the signal of the first node and the charging control signal, or outputting, by the charging control circuit, the second display voltage signal to the pixel electrode in response to the signal of the second node and the charging control signal.

DETAILED DESCRIPTION OF THE EMBODIMENTS

Figure 1:
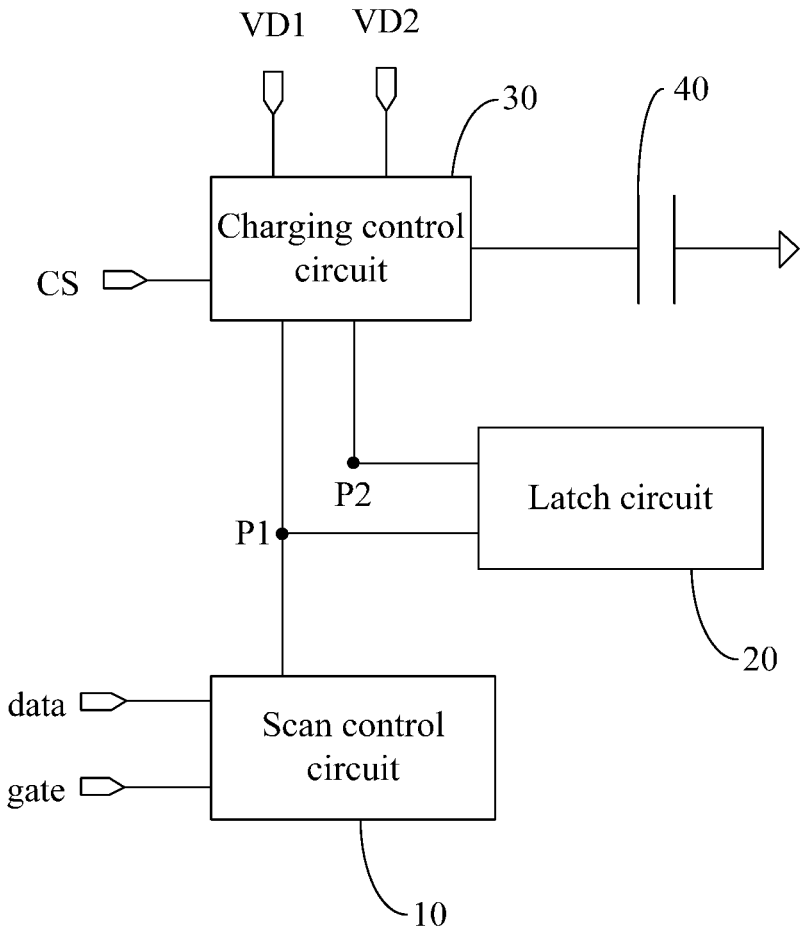
FIG. 1 is a first schematic structural diagram of a pixel circuit according to some embodiments of the disclosure.

At present, electronic paper is required to consume less power, so the capacitance of the storage capacitor in the pixel electrode becomes larger. In order to satisfy a charging demand, the size of the TFT also becomes larger. However the leakage current in the TFT with a larger size also becomes larger, so that the leakage current is so large that a white spot or another display defect may occur while the image is being displayed. Such a defect may occur more easily on the electronic paper with a larger size and a lower refresh frequency. Accordingly some embodiments of the disclosure provide a pixel circuit so as to alleviate leakage current, and to improve a display effect.

In order to make the objects, technical solutions, and advantages of the disclosure more apparent, particular implementations of a pixel circuit, a method for driving the same, a display panel, and a display device according to the embodiments of the disclosure will be described below in details with reference to the drawings. Apparently the embodiments to be described are only intended to illustrate and explain the disclosure, but not to limit the disclosure thereto. The embodiments of the disclosure, and the features in the embodiments can be combined with each other unless they conflict with each other. It shall be noted that the sizes and the shapes of respective components in the drawings will not reflect any real proportion, but are only intended to illustrate the disclosure of the disclosure. Furthermore like or similar reference numerals throughout the drawings will represent like or similar elements, or elements with like or similar functions.

Some embodiments of the disclosure provide a pixel circuit as illustrated in FIG. 1, which can include: a scan control circuit 10, a latch circuit 20, a charging control circuit 30, and a pixel electrode 40.

The scan control circuit 10 is configured to output a data signal "data" to a first node P1 in response to a gate scan signal "gate".

The latch circuit 20 is configured to latch the signals of the first node P1 and a second node P2 in response to the signal of the first node P1.

The charging control circuit 30 is configured to output a first display voltage signal VD1 to the pixel electrode 40 in response to the signal of the first node P1, and a charging control signal CS, and to output a second display voltage signal VD2 to the pixel electrode in response to the signal of the second node P2, and the charging control signal CS.

The pixel circuit according to some embodiments of the disclosure includes: a scan control circuit, a latch circuit, a charging control circuit, and a pixel electrode, where the scan control circuit outputs a data signal to a first node in response to a gate scan signal; the latch circuit latches the signals of the first node and a second node in response to the signal of the first node so that the signals of the first node and the second node can be latched in response to the data signal input to the first node; and the charging control circuit outputs a first display voltage signal to the pixel electrode in response to the signal of the first node, and a charging control signal, and outputs a second display voltage signal to the pixel electrode in response to the signal of the second node, and the charging control signal. In this way, after the scan control circuit is disabled, the pixel electrode can be charged constantly using the signals of the first node and the second node latched in the latch circuit, and the charging control circuit to thereby alleviate leakage current, and improve a display effect.

In a particular implementation, in some embodiments of the disclosure, the gate scan signal is a pulse signal, a valid pulse signal of the gate scan signal can be a high-level signal, the first display voltage signal can be a high-level signal, and the second display voltage signal can be a low-level signal. Furthermore the data signal can be a signal at one of two different levels, i.e., one of a high-level signal and a low-level signal, so that the signal of the first node can be a high-level signal or a low-level signal.

The disclosure will be described below in details. It shall be noted that embodiments are intended to better explain the disclosure, but not to limit the disclosure thereto.

Figure 2:
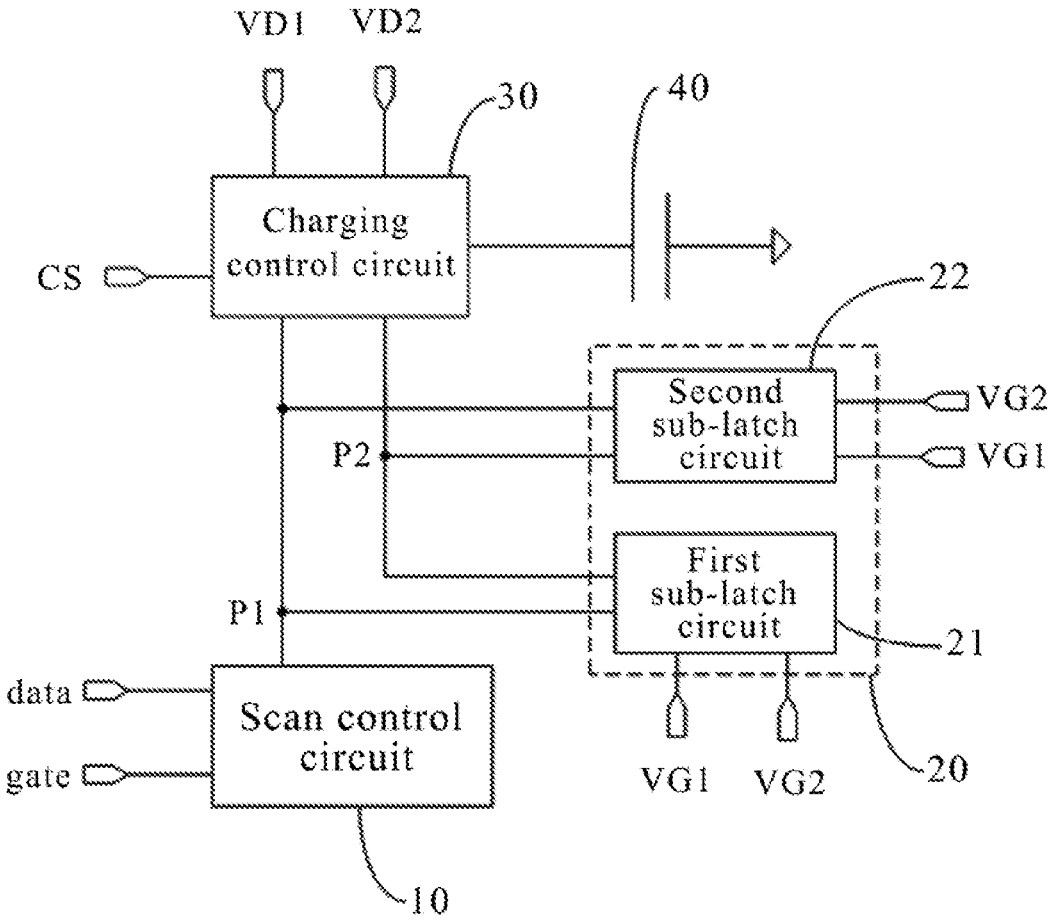
FIG. 2 is a second schematic structural diagram of the pixel circuit according to some embodiments of the disclosure.

In a particular implementation, in some embodiments of the disclosure, as illustrated in FIG. 2, the latch circuit 20 can include: a first sub-latch circuit 21 and a second sub-latch circuit 22, where the first sub-latch circuit 21 is configured to latch the signal of the second signal as a second reference voltage signal VG2 or a first reference voltage signal VG1 in response to the signal of the first node P1. Optionally, when the signal of the first node P1 is a high-level signal, the first sub-latch circuit 21 can latch the signal of the second node P2 as a low-level signal of the second reference voltage signal VG2. When the signal of the first node P1 is a low-level signal, the first sub-latch circuit 21 can latch the signal of the second node P2 as a high-level signal of the first reference voltage signal VG1.

The second sub-latch circuit 22 is configured to latch the signal of the first node P1 as the first reference voltage signal VG1 or the second reference voltage signal VG2 in response to the signal of the second node P2. Optionally, when the signal of the first node P1 is a high-level signal, the signal of the second node P2 is a low-level signal, and the second sub-latch circuit 22 can latch the signal of the first node P1 as a high-level signal of the first reference voltage signal VG1. When the signal of the first node P1 is a low-level signal, the signal of the second node P2 is a high-level signal, and the second sub-latch circuit 22 can latch the signal of the first node P1 as a low-level signal of the second reference voltage signal VG2.

Figure 3:
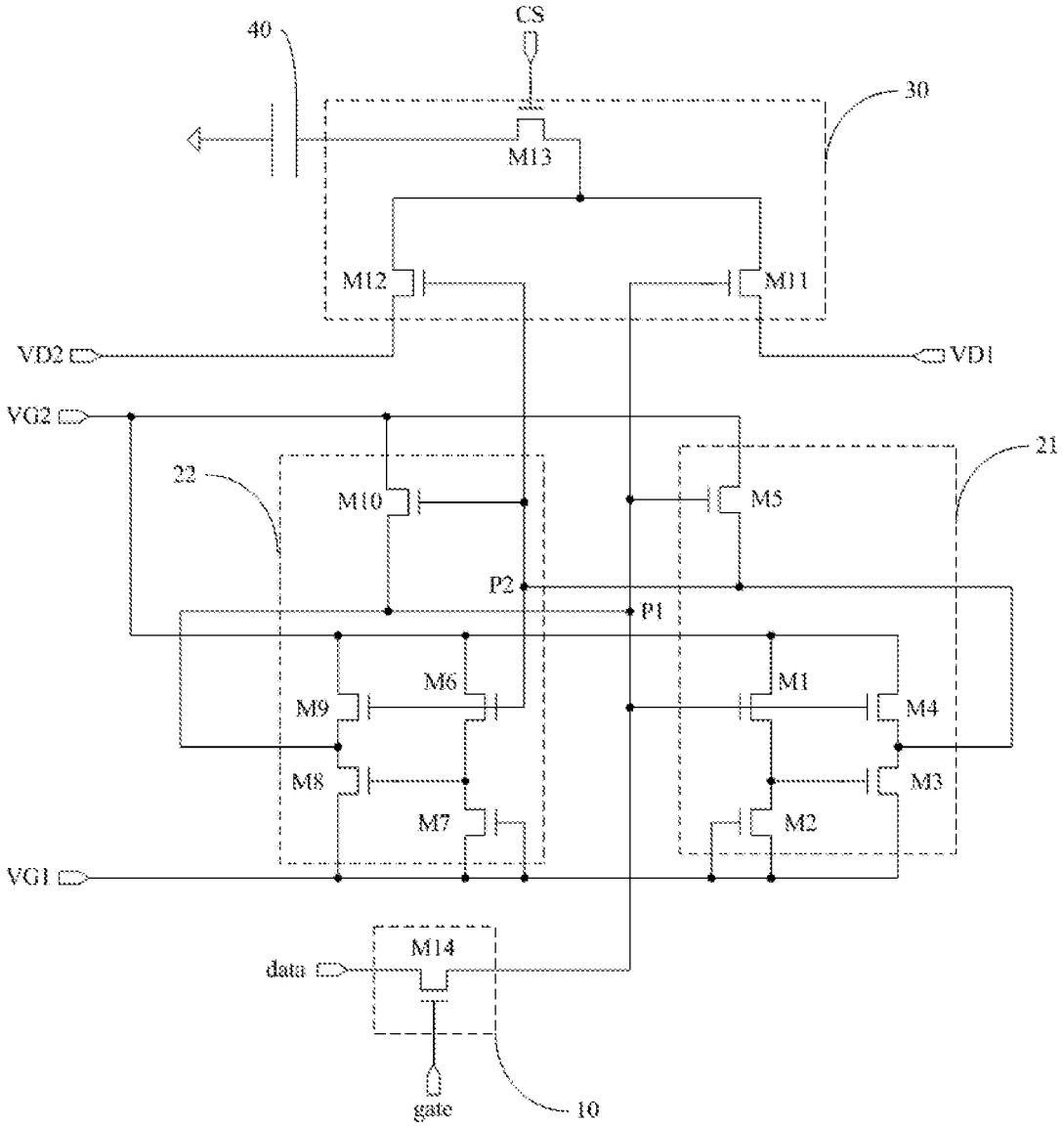
FIG. 3 is a schematic structural diagram in details of the pixel circuit according to some embodiments of the disclosure.

In a particular implementation, in some embodiments of the disclosure, as illustrated in FIG. 3, the first sub-latch circuit 21 can include: a first switch transistor M1, a second switch transistor M2, a third switch transistor M3, and a fourth switch transistor M4.

The first switch transistor M1 has a gate coupled with the first node P1, a first electrode configured to receive the second reference voltage signal VG2, and a second electrode coupled respectively with a second electrode of the second switch transistor M2, and a gate of the third switch transistor M3.

The second switch transistor M2 has a gate and a first electrode, both of which are configured to receive the first reference voltage signal VG1.

The third switch transistor M3 has a first electrode configured to receive the first reference voltage signal VG1, and a second electrode coupled with the second node P2.

The fourth switch transistor M4 has a gate coupled with the first node P1, a first electrode configured to receive the second reference voltage signal VG2, and a second electrode coupled with the second node P2.

Furthermore, in a particular implementation, in some embodiments of the disclosure, as illustrated in FIG. 3, the first sub-latch circuit 21 can further include a fifth switch transistor M5, where the fifth switch transistor M5 has a gate coupled with the first node P1, a first electrode coupled with the second node P2, and a second electrode configured to receive the second reference voltage signal VG2.

In a particular implementation, in some embodiments of the disclosure, as illustrated in FIG. 3, the first switch transistor M1 to the fifth switch transistor M5 can be N-type transistor, or the first switch transistor M1 to the fifth switch transistor M5 can be PN-type transistor, although embodiments of the disclosure will not be limited thereto.

In a particular implementation, in some embodiments of the disclosure, as illustrated in FIG. 3, the second sub-latch circuit 22 can include: a sixth switch transistor M6, a seventh switch transistor M7, an eighth switch transistor M8, and a ninth switch transistor M9.

The sixth switch transistor M6 has a gate coupled with the second node P2, a first electrode configured to receive the second reference voltage signal VG2, and a second electrode coupled respectively with a second electrode of the seventh switch transistor M7, and a gate of the eighth switch transistor M8.

The seventh switch transistor M7 has a gate and a first electrode, both of which are configured to receive the first reference voltage signal VG1.

The eighth switch transistor M8 has a first electrode configured to receive the first reference voltage signal VG1, and a second electrode coupled with the first node P1.

The ninth switch transistor M9 has a gate coupled with the second node P2, a first electrode configured to receive the second reference voltage signal VG2, and a second electrode coupled with the first node P1.

Furthermore, in a particular implementation, in some embodiments of the disclosure, as illustrated in FIG. 3, the second sub-latch circuit 22 can further include a tenth switch transistor M10, where the tenth switch transistor M10 has a gate coupled with the second node P2, a first electrode coupled with the first node P1, and a second electrode configured to receive the second reference voltage signal VG2.

In a particular implementation, in some embodiments of the disclosure, as illustrated in FIG. 3, the sixth switch transistor M6 to the tenth switch transistor M10 can be N-type transistors, or the sixth switch transistor M6 to the tenth switch transistor M10 can be P-type transistors, although embodiments of the disclosure will not be limited thereto.

In a particular implementation, in some embodiments of the disclosure, as illustrated in FIG. 3, the charging control circuit 30 can include: an eleventh switch transistor M11, a twelfth switch transistor M12, and a thirteenth switch transistor M13.

The eleventh switch transistor M11 has a gate coupled with the first node P1, a first electrode configured to receive the first display voltage signal VD1, and a second electrode coupled with the first electrode of the thirteenth switch transistor M13.

The twelfth switch transistor M12 has a gate coupled with the second node P2, a first electrode configured to receive the second display voltage signal VD2, and a second electrode coupled with the first electrode of the thirteenth switch transistor M13.

The thirteenth switch transistor M13 has a gate configured to receive the charging control signal CS, and a second electrode coupled with the pixel electrode 40.

In a particular implementation, in some embodiments of the disclosure, as illustrated in FIG. 3, the eleventh switch transistor M11 to the thirteenth switch transistor M13 can be N-type transistors, or the eleventh switch transistor M11 to the thirteenth switch transistor M13 can be P-type transistors, although embodiments of the disclosure will not be limited thereto.

In a particular implementation, in some embodiments of the disclosure, as illustrated in FIG. 3, the scan control circuit 10 can include a fourteenth switch transistor M14.

The fourteenth switch transistor M14 has a gate configured to receive the gate scan signal "gate", a first electrode configured to receive the data signal "data", and the second electrode coupled with the first node P1.

In a particular implementation, in some embodiments of the disclosure, as illustrated in FIG. 3, the fourteenth switch transistor M14 can be an N-type transistor, or the fourteenth switch transistor M14 can be a P-type transistor, although embodiments of the disclosure will not be limited thereto.

Particular structures of the respective circuits in the pixel circuit according to the embodiment of the disclosure has been described above only by way of an example, and in a particular implementation, the particular structures of the respective circuits above will not be limited to the structures above according to embodiments of the disclosure, but can alternatively be other structures which can occur to those skilled in the art, although embodiments of the disclosure will not be limited thereto.

Optionally, in order to simplify a fabrication process, in a particular implementation, in some embodiments of the disclosure, as illustrated in FIG. 3, all the switch transistors can be N-type transistors so that they can be produced massively on an a-Si substrate, or all the switch transistors can be P-type transistors, although embodiments of the disclosure will not be limited thereto.

Furthermore, in a particular implementation, an N-type transistor is switched on by a high-level signal, and switched off by a low-level signal, and a P-type transistor is switched off by a high-level signal, and switched on by a low-level signal.

It shall be noted that the switch transistors mentioned in the embodiment above of the disclosure can be Thin Film Transistors (TFTs), or can be Metal Oxide Semiconductor Field-Effect Transistors (MOSFETs), as needed in a real application context, although embodiments of the disclosure will not be limited thereto. In a particular implementation, the first electrodes of the transistors can be sources thereof, and the second electrodes thereof can be drains thereof; or the first electrodes of the transistors can be the drains thereof, and the second electrodes thereof can be the sources thereof, dependent upon the different types and input signals thereof, although the first electrodes and the second electrodes are not distinguished here from each other.

Figure 4:
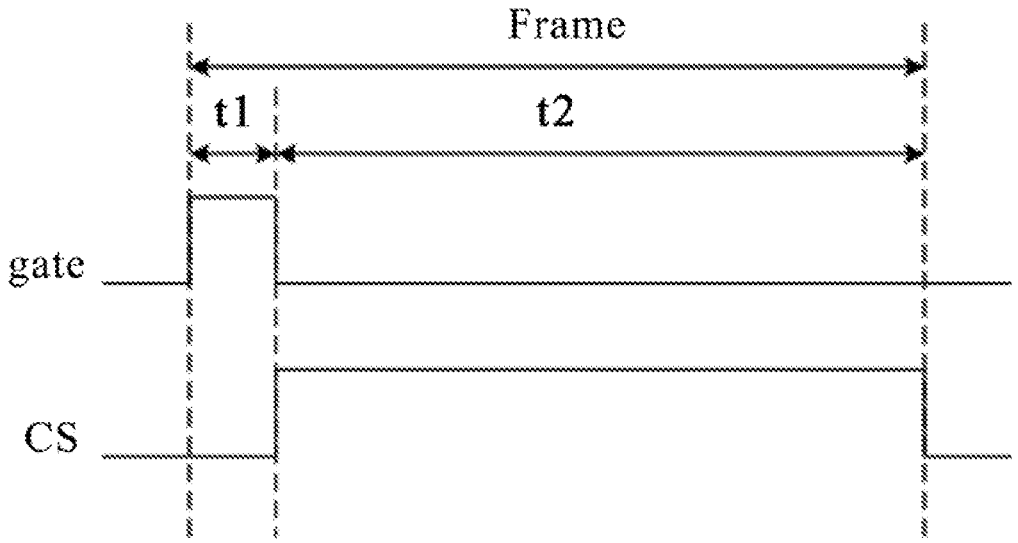
FIG. 4 is a timing diagram of the pixel circuit as illustrated in FIG. 3.

Taking the structure as illustrated in FIG. 3 as an example, an operating process of the pixel circuit above according to embodiments of the disclosure will be described below in connection with the timing diagram of the pixel circuit as illustrated in FIG. 4. In the following description, 1 represents a high-level signal, and 0 represents a low-level signal. Here FIG. 3 illustrates a timing diagram of only one pixel circuit in a row of pixel circuits in a period of time, Frame, for scanning one frame, by way of an example. Furthermore the first reference voltage signal is a high-level signal, and the second reference voltage signal is a low-level signal, for example. The period of time, Frame, for scanning one frame can include a data writing stage t1 and a charging stage t2.

Firstly an example in which the data signal is a high-level signal will be described.

In the data writing stage t1, gate=1, and CS=0. With CS=0, the thirteenth switch transistor M13 is switched off. With gate=1, the fourteenth switch transistor M14 is switched on to provide the high-level signal of the data signal "data" to the first node P1, so the signal of the first node P1 is a high-level signal. Since the signal of the first node P1 is a high-level signal, the first switch transistor M1, the fourth switch transistor M4, the fifth switch transistor M5, and the eleventh switch transistor M11 are switched on. The first switch transistor M1 which is switched on provides the low-level signal of the second reference voltage signal VG2 to the gate of the third switch transistor M3, and since the gate of the second switch transistor M2 is coupled with the first reference voltage signal VG1, the high-level signal of the first reference voltage signal VG1 can be provided to the gate of the third switch transistor M3, and the voltage of the first reference voltage signal VG1 and the second reference voltage signal VG2 can be set so that the voltage at the gate of the third switch transistor M3 is 0V, so the third switch transistor M3 is controlled to be switched off. The fourth switch transistor M4 which is switched on provides the low-level signal of the second reference voltage signal VG2 to the second node P2, so that the signal of the second node P2 is a low-level signal. Furthermore the fifth switch transistor M5 which is switched on provides the low-level signal of the second reference voltage signal VG2 to the second node P2, so that the signal of the second node P2 is still a low-level signal. Since the signal of the second node P2 is a low-level signal, all the sixth switch transistor M6, the ninth switch transistor M9, the tenth switch transistor M10, and the twelfth switch transistor M12 are switched off to thereby avoid the high-level signal of the first node P1 from being affected. Furthermore since the seventh switch transistor M7 is structured as a diode, the high-level signal of the first reference voltage signal VG1 is provided to the gate of the eighth switch transistor M8 to control the eighth switch transistor M8 to be switched on, and the high-level signal of the first reference voltage signal VG1 is provided to the first node P1 so that the signal of the first node P1 is still a high-level signal.

In the charging state t2, gate=0, and CS=1. With gate=0, the fourteenth switch transistor M14 is switched off. With CS=1, the thirteenth switch transistor M13 is switched on. Since the signal of the first node P1 is latched as a high-level signal, and the signal of the second node P2 is latched as a low-level signal, the eleventh switch transistor M11 is switched on, and the twelfth switch transistor M12 is switched off. The thirteenth switch transistor M13 and the eleventh switch transistor M11, which are switched on can provide the high-level signal of the first display voltage signal VD1 to the pixel electrode 40 so that the pixel electrode 40 can be a high-level signal throughout the charging stage t2, so when the pixel circuit is applied to a display device, the display device can display in black, thus alleviating leakage current, and improving a display effect.

Secondly an example in which the data signal is a low-level signal will be described. In the data writing stage t1, gate=1, and CS=0. With CS=0, the thirteenth switch transistor M13 is switched off. With gate=1, the fourteenth switch transistor M14 is switched on to provide the low-level signal of the data signal "data" to the first node P1, so the signal of the first node P1 is a low-level signal. Since the signal of the first node P1 is a low-level signal, the first switch transistor Ml, the fourth switch transistor M4, the fifth switch transistor M5, and the eleventh switch transistor M11 are switched off. Since the second switch transistor M2 is structured as a diode, the high-level signal of the first reference voltage signal VG1 is provided to the gate of the third switch transistor M3 to control the third switch transistor M3 to be switched on, and the high-level signal of the first reference voltage signal VG1 is provided to the second node P2 so that the signal of the second node P2 is a high-level signal. Since the signal of the second node P2 is a high-level signal, all the sixth switch transistor M6, the ninth switch transistor M9, the tenth switch transistor M10, and the twelfth switch transistor M12 are switched on. The sixth switch transistor M6 which is switched on provides the low-level signal of the second reference voltage signal VG2 to the gate of the eighth switch transistor M8, and since the gate of the seventh switch transistor M7 is coupled with the first reference voltage signal VG1, the high-level signal of the first reference voltage signal VG1 can be provided to the gate of the eighth switch transistor M8, and the voltage of the first reference voltage signal VG1 and the second reference voltage signal VG2 can be set so that the voltage at the gate of the eighth switch transistor M8 is 0V, so the eighth switch transistor M8 is controlled to be switched off. The ninth switch transistor M9 which is switched on provides the low-level signal of the second reference voltage signal VG2 to the first node P1 so that the signal of the first node P1 is a low-level signal. Furthermore the tenth switch transistor M10 which is switched on provides the low-level signal of the second reference voltage signal VG2 to the first node P1 so that the signal of the first node P1 is still a low-level signal.

In the charging state t2, gate=0, and CS=1. With gate=0, the fourteenth switch transistor M14 is switched off. With CS=1, the thirteenth switch transistor M13 is switched on. Since the signal of the first node P1 is latched as a low-level signal, and the signal of the second node P2 is latched as a high-level signal, the eleventh switch transistor M11 is switched off, and the twelfth switch transistor M12 is switched on. The thirteenth switch transistor M13 and the twelfth switch transistor M12, which are switched on can provide the low-level signal of the second display voltage signal VD2 to the pixel electrode 40 so that the pixel electrode 40 can be a low-level signal throughout the charging stage t2, so when the pixel circuit is applied to a display device, the display device can display in white, thus alleviating leakage current, and improving a display effect.

It shall be noted that the first reference voltage signal and the first display signal can be the same signal, and the second reference voltage signal and the second display signal can be the same signal, thus reducing the number of signal lines, and narrowing a space occupied by the routed wires. Furthermore the voltage of the first reference voltage signal, and the voltage of the second reference voltage signal can be set as needed in a real application context, although embodiments of the disclosure will not be limited thereto.

Based upon the same inventive idea, some embodiments of the disclosure further provide a method for driving a pixel circuit, and since the driving method addresses the problem under a similar principle to the pixel circuit above, reference can be made to the implementation of the pixel circuit above for an implementation of the driving method, and a repeated description thereof will be omitted here.

Figure 5:
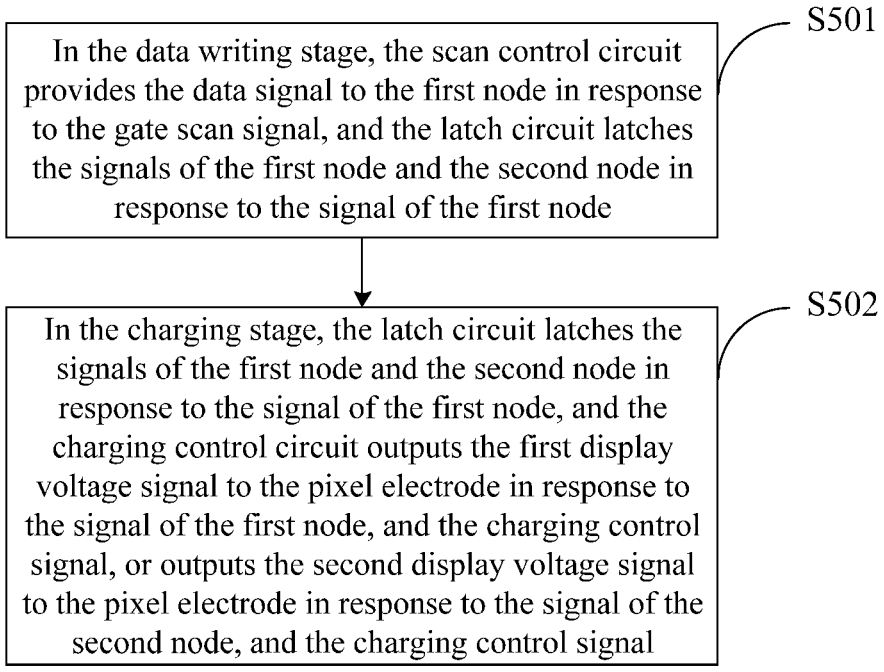
FIG. 5 is a flow chart of a method for driving the pixel circuit according to some embodiments of the disclosure.

As illustrated in FIG. 5, the method for driving a pixel circuit according to the embodiment of the disclosure can include: a data writing stage and a charging stage.

In the step S501, in the data writing stage, the scan control circuit provides the data signal to the first node in response to the gate scan signal, and the latch circuit latches the signals of the first node and the second node in response to the signal of the first node.

In the step S502, in the charging stage, the latch circuit latches the signals of the first node and the second node in response to the signal of the first node, and the charging control circuit outputs the first display voltage signal to the pixel electrode in response to the signal of the first node, and the charging control signal, or outputs the second display voltage signal to the pixel electrode in response to the signal of the second node, and the charging control signal.

Figure 6:
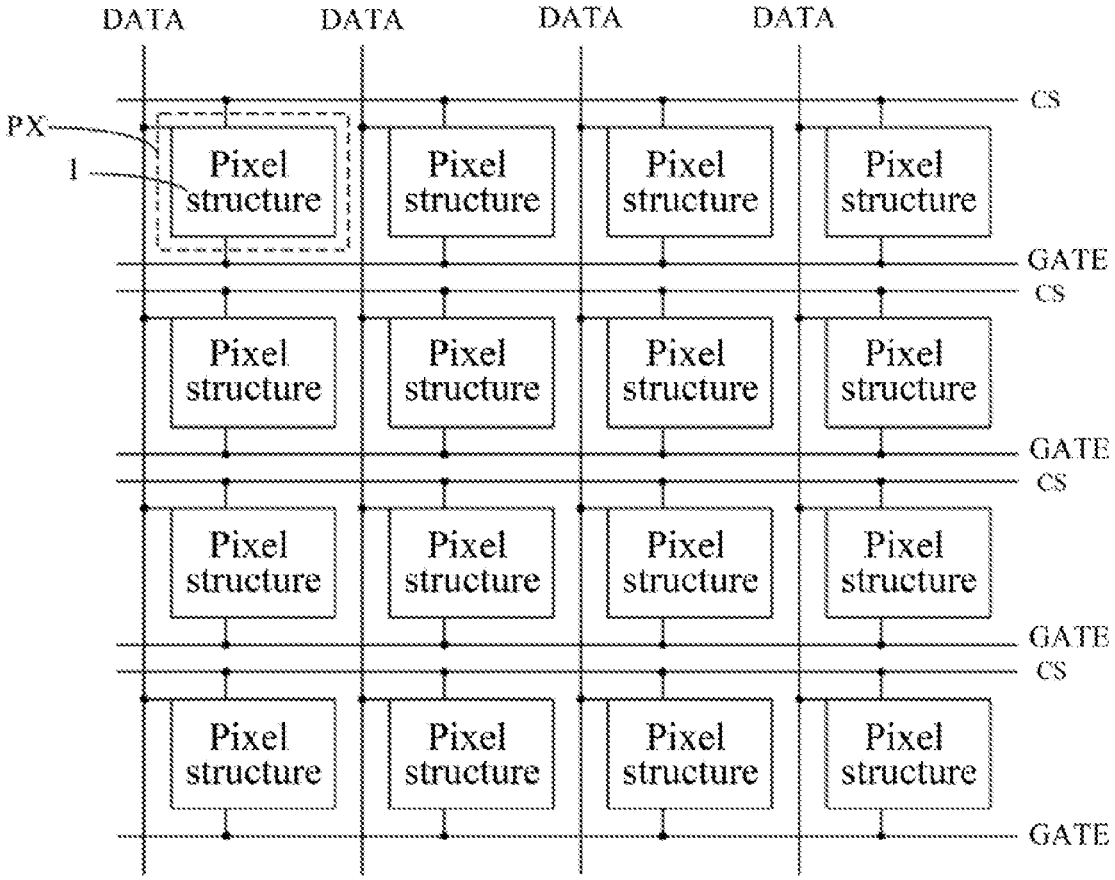
FIG. 6 is a schematic structural diagram of a display panel according to some embodiments of the disclosure.

Based upon the same inventive idea, some embodiments of the disclosure further provide an array substrate as illustrated in FIG. 6, which can include: a plurality of pixel elements PX, a plurality of gate lines GATE, a plurality of charging control signal lines cs, and a plurality of data lines DATA, where each row of pixel elements PX corresponds to one of the gate lines GATE, and one of the charging control signal lines cs, and a column of pixel elements PX corresponds to one of the data lines DATA.

The respective pixel elements PX include the pixel circuits 1 according to some embodiments above of the disclosure, where the respective gate lines are coupled with their corresponding pixel circuits, and configured to transmit the gate scan signal, the respective charging control signal lines are coupled with their corresponding pixel circuits, and configured to transmit the charging control signal, and the respective data lines are coupled with their corresponding pixel circuits, and configured to transmit the data signal. Furthermore, the pixel circuits 1 are structured as illustrated in FIG. 1 to FIG. 3, so a repeated description thereof will be omitted here. The array substrate addresses the problem under a similar principle to the pixel circuit above, reference can be made to the implementation of the pixel circuit above for an implementation of the array substrate, and a repeated description thereof will be omitted here.

Furthermore, in a particular implementation, in some embodiments of the disclosure, the array substrate can further include: a first display voltage signal line configured to transmit the first display voltage signal, a second display voltage signal line configured to transmit the first display voltage signal, a first reference voltage signal line configured to transmit the first reference voltage signal, and a second reference voltage signal line configured to transmit the second reference voltage signal, where the first reference voltage signal line and the second reference voltage signal line can extend in the row direction of the pixel elements, and the first display voltage signal line and the second display voltage signal line can extend in the column direction of the pixel elements.

In a particular implementation, in some embodiments of the disclosure, the gate lines and the charging control signal lines extend respectively in the row direction of the pixel elements. Furthermore, the gate line and the charging control signal line corresponding to the same row of pixel elements can be located respectively on two facing sides of the pixel elements. Of course, the gate line and the charging control signal line corresponding to the same row of pixel elements can alternatively be located respectively in the same gap between two adjacent pixel elements.

Based upon the same inventive idea, some embodiments of the disclosure further provide a display device including the array substrate above according to embodiments of the disclosure. The display device addresses the problem under a similar principle to the array substrate above, so reference can be made to the implementation of the array substrate above for an implementation of the display device, and a repeated description thereof will be omitted here.

In a particular implementation, the display device according to embodiments of the disclosure can include electronic paper, or can include a mobile phone, a tablet computer, a TV set, a monitor, a notebook computer, a digital photo frame, a navigator, or any other product or component with a display function. All the other components indispensable to the display device shall readily occur to those ordinarily skilled in the art, so a repeated description thereof will be omitted here, and the embodiment of the disclosure will not be limited thereto.

Optionally, the electronic paper can include: an array substrate and an opposite substrate, both of which are arranged to each other, and an electronic ink layer encapsulated between the array substrate and the opposite substrate.

In the pixel circuit, the method for driving the same, the display panel, and the display device according to the embodiments of the disclosure, the pixel circuit includes: a scan control circuit, a latch circuit, a charging control circuit, and a pixel electrode, where the scan control circuit outputs a data signal to a first node in response to a gate scan signal; the latch circuit latches the signals of the first node and a second node in response to the signal of the first node so that the signals of the first node and the second node can be latched in response to the data signal input to the first node; and the charging control circuit outputs a first display voltage signal to the pixel electrode in response to the signal of the first node, and a charging control signal, and outputs a second display voltage signal to the pixel electrode in response to the signal of the second node, and the charging control signal. In this way, after the scan control circuit is disabled, the pixel electrode can be charged constantly using the signals of the first node and the second node latched in the latch circuit, and the charging control circuit to thereby alleviate leakage current, and improve a display effect.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel circuit, comprising: a scan control circuit, a latch circuit, a charging control circuit, and a pixel electrode, wherein:

the scan control circuit is configured to output a data signal to a first node in response to a gate scan signal;

the latch circuit is configured to latch signals of the first node and a second node response to a signal of the first node; and the charging control circuit is configured to output a first display voltage signal to the pixel electrode in response to the signal of the first node and a charging control signal, and to output a second display voltage signal to the pixel electrode in response to the signal of the second node and the charging control signal;

wherein the latch circuit comprises: a first sub-latch circuit and a second sub-latch circuit, wherein:

the first sub-latch circuit is configured to latch the signal of the second node as a second reference voltage signal or a first reference voltage signal in response to the signal of the first node; and the second sub-latch circuit is configured to latch the signal of the first node as the first reference voltage signal or the second reference voltage signal in response to the signal of the second node;

wherein the first sub-latch circuit comprises: a first switch transistor, a second switch transistor, a third switch transistor, and a fourth switch transistor, wherein:

the first switch transistor has a gate coupled with the first node, a first electrode configured to receive the second reference voltage signal, and a second electrode coupled respectively with a second electrode of the second switch transistor and a gate of the third switch transistor;

the second switch transistor has a gate and a first electrode, both of which are configured to receive the first reference voltage signal;

the third switch transistor has a first electrode configured to receive the first reference voltage signal, and a second electrode coupled with the second node; and the fourth switch transistor has a gate coupled with the first node, a first electrode configured to receive the second reference voltage signal, and a second electrode coupled with the second node;

the first switch transistor, the second switch transistor, the third switch transistor and the fourth switch transistor are of same transistor type.

2. The pixel circuit according to claim 1, wherein the first sub-latch circuit further comprises a fifth switch transistor, wherein:

the fifth switch transistor has a gate coupled with the first node, a first electrode coupled with the second node, and a second electrode configured to receive the second reference voltage signal.

3. The pixel circuit according to claim 1, wherein the second sub-latch circuit comprises: a sixth switch transistor, a seventh switch transistor, an eighth switch transistor, and a ninth switch transistor, wherein:

the sixth switch transistor has a gate coupled with the second node, a first electrode configured to receive the second reference voltage signal, and a second electrode coupled respectively with a second electrode of the seventh switch transistor, and a gate of the eighth switch transistor;

the seventh switch transistor has a gate and a first electrode, both of which are configured to receive the first reference voltage signal;

the eighth switch transistor has a first electrode configured to receive the first reference voltage signal, and a second electrode coupled with the first node; and the ninth switch transistor has a gate coupled with the second node, a first electrode configured to receive the second reference voltage signal, and a second electrode connected with the first node.

4. The pixel circuit according to claim 3, wherein the second sub-latch circuit further comprises a tenth switch transistor, wherein:

the tenth switch transistor has a gate coupled with the second node, a first electrode coupled with the first node, and a second electrode configured to receive the second reference voltage signal.

5. The pixel circuit according to claim 1, wherein the charging control circuit comprises: an eleventh switch transistor, a twelfth switch transistor, and a thirteenth switch transistor, wherein:

the eleventh switch transistor has a gate coupled with the first node, a first electrode configured to receive the first display voltage signal, and a second electrode coupled with the first electrode of the thirteenth switch transistor;

the twelfth switch transistor has a gate coupled with the second node, a first electrode configured to receive the second display voltage signal, and a second electrode coupled with the first electrode of the thirteenth switch transistor; and the thirteenth switch transistor has a gate configured to receive the charging control signal, and a second electrode coupled with the pixel electrode.

6. The pixel circuit according to claim 1, wherein the scan control circuit comprises a fourteenth switch transistor, wherein:

the fourteenth switch transistor has a gate configured to receive the gate scan signal, a first electrode configured to receive the data signal, and the second electrode coupled with the first node.

7. An array substrate, comprising: a plurality of pixel elements, a plurality of gate lines, a plurality of charging control signal lines, and a plurality of data lines, wherein each row of pixel elements corresponds to one of the gate lines and one of the charging control signal lines, and a column of pixel elements corresponds to one of the data lines; and respective pixel elements comprise the pixel circuit according to claim 1, wherein respective gate lines are coupled with their corresponding pixel circuits, and configured to transmit the gate scan signal, respective charging control signal lines are coupled with their corresponding pixel circuits, and configured to transmit the charging control signal, and respective data lines are coupled with their corresponding pixel circuits, and configured to transmit the data signal.

8. The array substrate according to claim 7, wherein the first sub-latch circuit further comprises a fifth switch transistor, wherein:

the fifth switch transistor has a gate coupled with the first node, a first electrode coupled with the second node, and a second electrode configured to receive the second reference voltage signal.

9. The array substrate according to claim 7, wherein the second sub-latch circuit comprises: a sixth switch transistor, a seventh switch transistor, an eighth switch transistor, and a ninth switch transistor, wherein:

the sixth switch transistor has a gate coupled with the second node, a first electrode configured to receive the second reference voltage signal, and a second electrode coupled respectively with a second electrode of the seventh switch transistor, and a gate of the eighth switch transistor;

the seventh switch transistor has a gate and a first electrode, both of which are configured to receive the first reference voltage signal;

the eighth switch transistor has a first electrode configured to receive the first reference voltage signal, and a second electrode coupled with the first node; and the ninth switch transistor has a gate coupled with the second node, a first electrode configured to receive the second reference voltage signal, and a second electrode connected with the first node.

10. The array substrate according to claim 9, wherein the second sub-latch circuit further comprises a tenth switch transistor, wherein:

the tenth switch transistor has a gate coupled with the second node, a first electrode coupled with the first node, and a second electrode configured to receive the second reference voltage signal.

11. The array substrate according to claim 7, wherein the charging control circuit comprises: an eleventh switch transistor, a twelfth switch transistor, and a thirteenth switch transistor, wherein:

the eleventh switch transistor has a gate coupled with the first node, a first electrode configured to receive the first display voltage signal, and a second electrode coupled with the first electrode of the thirteenth switch transistor;

the twelfth switch transistor has a gate coupled with the second node, a first electrode configured to receive the second display voltage signal, and a second electrode coupled with the first electrode of the thirteenth switch transistor; and the thirteenth switch transistor has a gate configured to receive the charging control signal, and a second electrode coupled with the pixel electrode.

12. The array substrate according to claim 7, wherein the scan control circuit comprises a fourteenth switch transistor, wherein:

the fourteenth switch transistor has a gate configured to receive the gate scan signal, a first electrode configured to receive the data signal, and the second electrode coupled with the first node.

13. A display device, comprising the array substrate according to claim 7.

14. The display device according to claim 13, wherein the display device comprises electronic paper.

15. A method for driving the pixel circuit according to claim 1, the method comprising: a data writing stage and a charging stage, wherein:

in the data writing stage, outputting, by the scan control circuit, the data signal to the first node in response to the gate scan signal, and latching, by the latch circuit, the signals of the first node and the second node in response to the signal of the first node;

in the charging stage, latching, by the latch circuit, the signals of the first node and the second node in response to the signal of the first node, and outputting, by the charging control circuit the first display voltage signal to the pixel electrode in response to the signal of the first node and the charging control signal, or outputting, by the charging control circuit, the second display voltage signal to the pixel electrode in response to the signal of the second node and the charging control signal.

* * * * *